US012631369B2

(12) United States Patent
Qiu et al.

(10) Patent No.: US 12,631,369 B2
(45) Date of Patent: May 19, 2026

(54) CIRCULATING HEATING WATER HEATER

(71) Applicant: Jiaxing Virpol Sanitary Ware co., LTD., Jiaxing (CN)

(72) Inventors: Baisi Qiu, Jiaxing (CN); Baien Qiu, Jiaxing (CN)

(73) Assignee: Jiaxing Virpol Sanitary Ware co., LTD.

( * ) Notice: Subject to any disclaimer, the term of this patent is extended or adjusted under 35 U.S.C. 154(b) by 0 days.

(21) Appl. No.: 19/346,315

(22) Filed: Sep. 30, 2025

(65) Prior Publication Data

US 2026/0029158 A1 Jan. 29, 2026

(51) Int. Cl.
*F24H 1/10* (2022.01)
*F24H 9/00* (2022.01)
*F24H 9/25* (2022.01)

(52) U.S. Cl.
CPC ..... *F24H 1/10* (2013.01); *F24H 9/001* (2013.01); *F24H 9/25* (2022.01)

(58) Field of Classification Search
CPC ..... F24H 1/10; F24H 9/25; F24H 9/001
See application file for complete search history.

(56) References Cited

U.S. PATENT DOCUMENTS

2007/0192952 A1* 8/2007 Lau ..... A61H 33/027 4/541.1
2011/0203572 A1* 8/2011 Jackman ..... F24D 11/003 126/714
2019/0070070 A1* 3/2019 Mulcahy ..... A61H 33/0095
2019/0128565 A1* 5/2019 Pugh ..... F25B 49/02
2019/0175445 A1* 6/2019 Hsu ..... A61H 33/02
2024/0191528 A1* 6/2024 Zeng ..... E04H 4/0025
2024/0197563 A1* 6/2024 Zhang ..... H02H 3/162
2025/0155143 A1* 5/2025 Tomalin ..... F24F 11/84

* cited by examiner

*Primary Examiner* — Alfred Basichas
(74) *Attorney, Agent, or Firm* — All West Law Group PLLC; Aaron Powell

(57) ABSTRACT

A circulating heating water heater includes a circulating heating system which further comprises a housing, a circulating pump, a heater, a water inlet pipe and a water outlet pipe; the circulating pump and the heater are arranged inside the housing, and a water inlet of the circulating pump communicates the water inlet pipe with the water inlet of the heater via a water inlet tee valve; a water outlet of the circulating pump communicates the water outlet pipe with a water outlet of the heater via another water outlet tee valve; the water outlet pipe and the water inlet pipe extend to an outside of the housing.

9 Claims, 4 Drawing Sheets

CIRCULATING HEATING WATER HEATER

TECHNICAL FIELD

The present invention belongs to the technical field of bathroom equipment, and in particular relates to a circulating heating water heater.

TECHNICAL BACKGROUND

When taking a shower by using a traditional bathtub, the water temperature will gradually decrease, which affects shower experience. Although some high-end bathtubs are provided with a circulating heating system, the pipeline of the circulating heating system is arranged at the bottom of the bathtub which is long and exposed outside with large heat exchange area, resulting in serious heat loss of the liquid during the flow process and the energy efficiency utilization rate is low. In order to compensate for the heat loss along the way, the heating apparatus usually needs to work longer with higher power, which not only causes waste of energy, but also increases the daily use cost for users.

Invention Content

In order to overcome the shortcomings of the prior art, the present invention provides a circulating heating water heater, which integrates a circulating pump and a heater inside the housing of the heater so as to shorten the length of a pipeline, avoid the heat loss, and reduce heat exchange area, thereby reducing energy consumption, improving energy utilization efficiency, and saving usage costs.

The technical solution adopted by the present invention for solving the technical problem is:

A circulating heating water heater comprises a circulating heating system, which further comprises a housing, a circulating pump, a heater, a water inlet pipe and a water outlet pipe; the circulating pump and the heater are arranged inside the housing; a water inlet of the circulating pump communicates with the water inlet pipe and the water inlet of the heater via a water inlet tee valve; a water outlet of the circulating pump communicates with the water outlet pipe and the water outlet of the heater via another water outlet tee valve; the water outlet pipe and the water inlet pipe extend to the outside of the housing.

Further, the circulating heating water heater further comprises a diverter tee valve, a jointer tee valve and a sterilizer; two horizontal entrances of the diverter tee valve respectively communicate with the water inlet of the circulating pump and the water inlet of the heater; a vertical entrance of the diverter tee valve communicates with a water inlet of the sterilizer; two horizontal entrances of the jointer tee valve respectively communicate with a water outlet of the heater and the water outlet of the circulating pump; a vertical entrance of the jointer tee valve communicates with a water outlet of the sterilizer.

Further, the water inlet pipe and the water outlet pipe are provided with a two-way valve respectively.

Further, the circulating pump is wound by a cooling hose; one end of the cooling hose communicates with a vertical entrance of a first cooling tee valve; two horizontal entrances of the first cooling tee valve respectively communicate with the water inlet of the heater and the water inlet tee valve; another end of the cooling hose communicates with a vertical entrance of a second cooling tee valve; two horizontal entrances of the second cooling tee valve respectively communicates with the water outlet of the heater and the water outlet tee valve.

Further, the sterilizer is an ozone sterilizer.

Further, the circulating heating water heater comprises a control panel, which is electrically connected to the heater, the sterilizer and the circulating pump.

Further, a muffler is provided to envelop the outer peripheries of the water inlet pipe and the water outlet pipe.

Further, the housing is provided with a loudspeaker, which includes a wireless transmission module.

Further, the circulating heating water heater also comprises an air switch and a soft bathtub; the air switch is connected to the soft bathtub via an air pipe, which is provided with an air valve.

Further, the soft bathtub is provided with a cavity; an inner surface of the cavity is provided with a plurality of nozzles, at least two backwater outlets and a filter.

The beneficial effects of the present invention are as follows:

First, it is highly integrated and improves energy efficiency. By integrating a circulating pump and a heater in the same housing, the length of a pipeline is significantly shortened, thereby reducing the heat loss, heat exchange area, and energy consumption to improve energy utilization efficiency and save usage costs.

Second, it is provided with an integrated ozone sterilizer, which realizes sterilization and disinfection of circulating water.

Third, it supports a hydraulic massage function by setting an air switch. The air switch is connected to the soft bathtub via an air pipe; a plurality of nozzles (a water nozzle and an air nozzle) are arranged on an inner surface of the soft bathtub; as a result, it provides users with air bubble massage and white noise experience.

Fourth, it also provides multiple working modes to satisfy users' different requirements.

DESCRIPTION OF MARKS IN FIGURES

Figure 1:
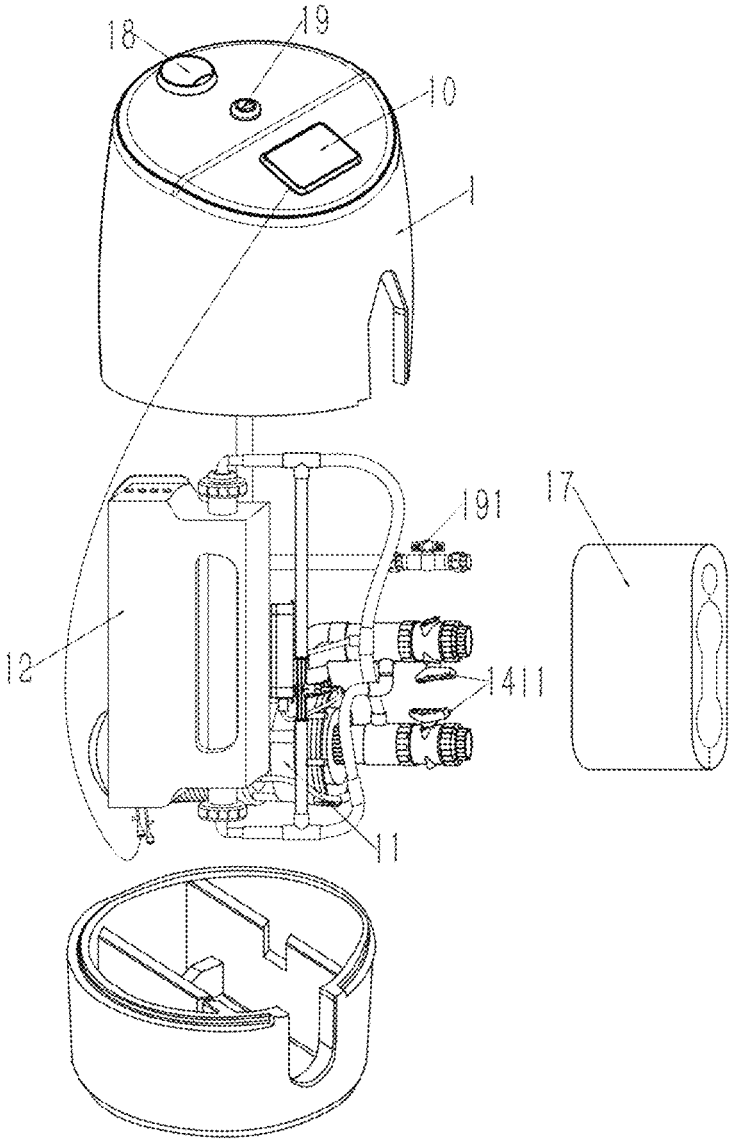
FIG. 1 is an exploded view of a circulating heating water heater.
Figure 2:
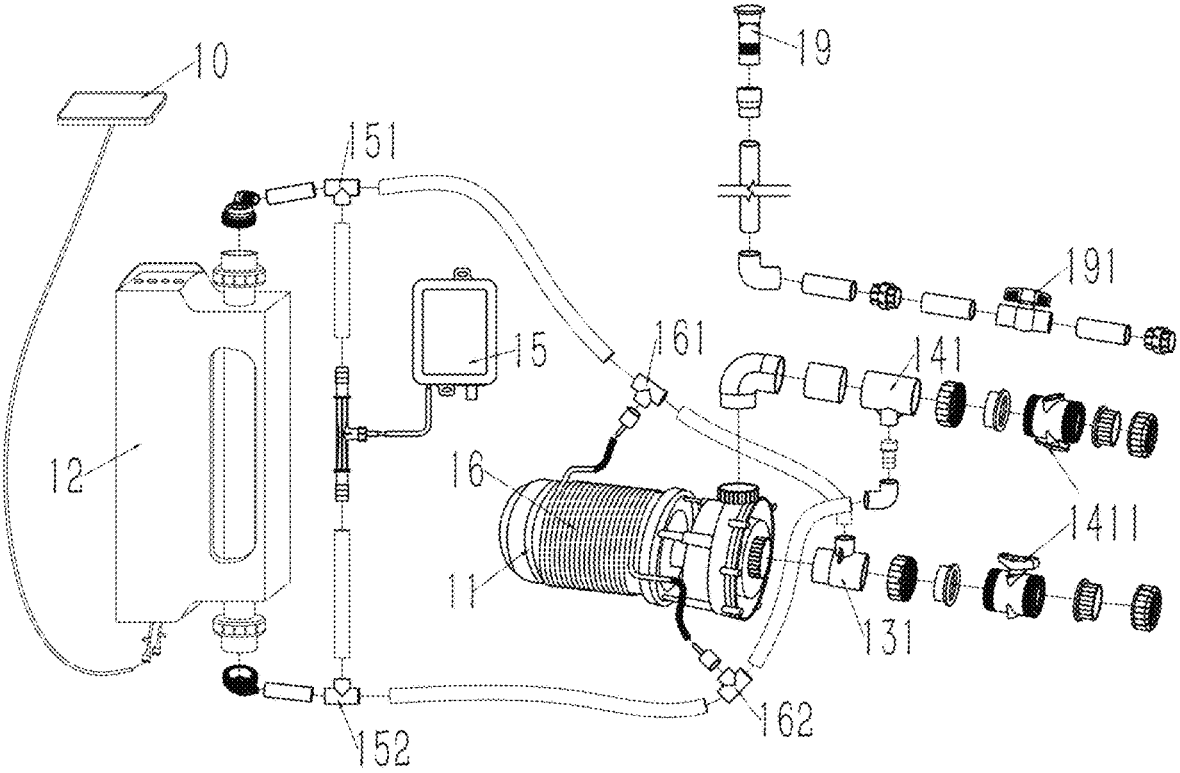
FIG. 2 is an exploded view of a circulating heating system of the circulating heating water heater.
Figure 3:
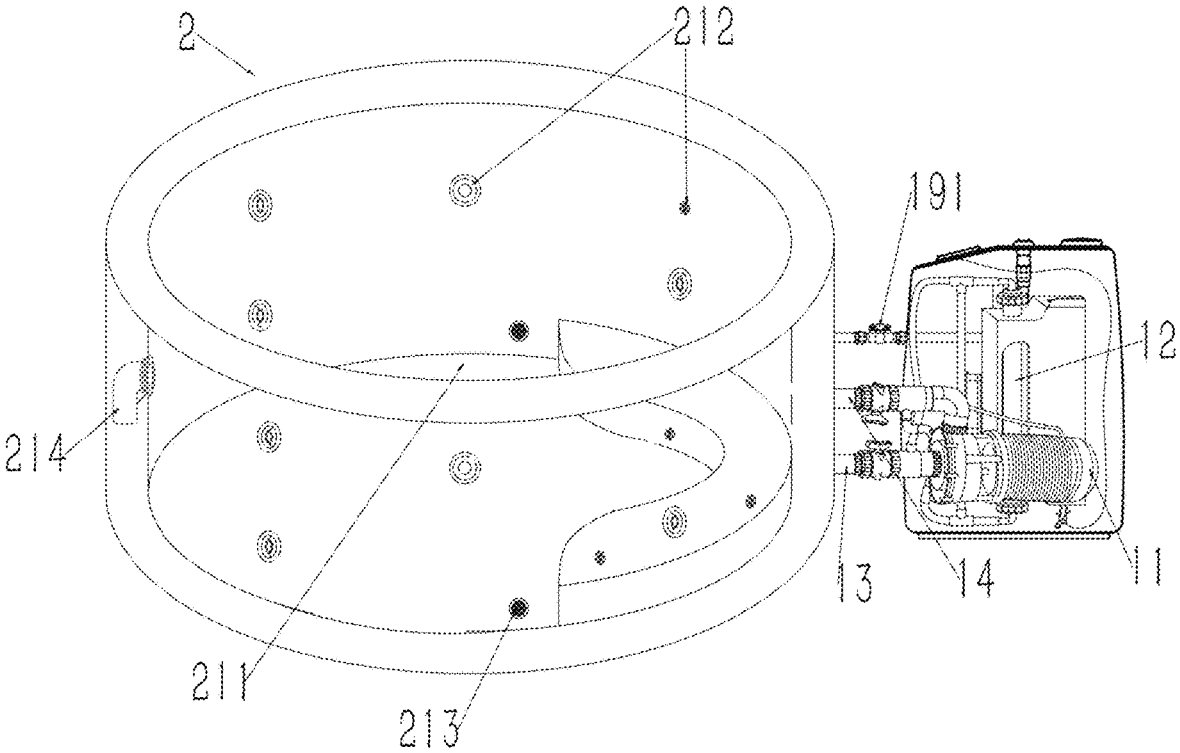
FIG. 3 is a schematic diagram of the circulating heating water heater.

1—housing; 10—control panel; 11—circulating pump; 12—heater;

13—water inlet pipe; 131—water inlet tee valve; 132—backwater pipe;

14—water outlet pipe; 141—water outlet tee valve; 1411—two-way valve; 142—transportation pipe;

15—sterilizer; 151—diverter tee valve; 152—jointer tee valve;

16—cooling hose; 161—first cooling tee valve; 162—second cooling tee valve;

17—muffler;

18—loudspeaker;

19—air switch; 191—air valve; 192—air pipe; 193—air duct;

2—soft bathtub; 20—outer surface; 21—inner surface; 211—cavity; 212—nozzle;

213—backwater outlet; 214—filter.

DETAILED DESCRIPTION OF THE EMBODIMENTS

The present embodiment only shows an explanation of the present invention, and it is not a limitation to the present invention. The skilled in the art can make modifications to this embodiment as needed without making any creative contributions after reading this specification, which are always protected by the patent law as long as they are within the scope of the claims of the present invention.

Referring to FIG. 1 to FIG. 4, in this embodiment, a circulating heating water heater includes a circulating heating system, which comprises a housing 1, a circulating pump 11, a heater 12, a water inlet pipe 13 and a water outlet pipe 14; the circulating pump 11 and the heater 12 are arranged inside the housing 1, and a water inlet of the circulating pump 11 communicates the water inlet pipe 13 with the water inlet of the heater 12 via a water inlet tee valve 131; a water outlet of the circulating pump 11 communicates the water outlet pipe 14 and the water outlet of the heater 12 via another water outlet tee valve 141; the water outlet pipe 14 and the water inlet pipe 13 extend to an outside of the housing 1.

Compared with a conventional water heater on the market, this embodiment provides a circulating heating water heater, which integrates a circulating pump 11 and the heater 12 inside the housing 1 of the heater 11 so as to shorten the length of a pipeline, thereby shortening the distance of the liquid flow to avoid the heat loss. In addition, the compact integrated layout can also reduce heat exchange area, thereby reducing the energy consumption, improving the energy utilization efficiency, and saving usage costs.

Preferably, housing 1 is made of foam material, which has a good thermal insulation effect so as to avoid heat loss at root. In practical application, housing 1 can be made of high-strength Acrylonitrile Butadiene Styrene plastic, so that the structure support and protection performance are ensured with light weight at the same time.

Preferably, the circulating heating water heater further comprises a diverter tee valve 151, a jointer tee valve 152 and a sterilizer 15; two horizontal entrances of the diverter tee valve 151 respectively communicates with the water inlet of the circulating pump 11 and a water inlet of the heater 12; a vertical entrance of the diverter tee valve communicates with a water inlet of the sterilizer 15; two horizontal entrances of the jointer tee valve 152 respectively communicates with a water outlet of the heater 12 and the water outlet of the circulating pump 11; a vertical entrance of the diverter tee valve communicates with the water outlet of the sterilizer 15.

Preferably, sterilizer 15 is an ozone sterilizer. A heated water stream and a disinfected liquid converge on the jointer tee valve 152 and finally flow through the water outlet valve 14 so as to achieve sterilization and disinfection of the water in the circulating system.

The circulating pump 11 will heat, vibrate and produce noise at work, these will degrade the performance of the circulating pump 11. In order to solve these problem, the circulating pump 11 is wound by a cooling hose 16; one end of the cooling hose 16 communicates with a vertical entrance of a first cooling tee valve 161; two horizontal entrances of the first cooling tee valve 161 respectively communicates with the water inlet of the heater 12 and the water inlet tee valve 131; another end of the cooling hose 16 communicates with a second cooling tee valve 162; two horizontal entrances of the second cooling tee valve 162 respectively communicates with the water outlet of the heater 12 and the water outlet tee valve 141.

With such arrangement, a part of the inflow water will be diverted to the cooling hose 16 via the first cooling tee valve 161; when the inflow water flows through the cooling hose 16, the inflow water takes away the heat on the surface of the circulating pump 11 directly and efficiently, and the circulating pump 11 works at a low temperature environment. This auxiliary cooling mechanism helps protect the internal components of the circulating pump 11 and prevents damage caused by overheating. More importantly, it realizes the cooling function without complex modification of the pump body, which not only prolongs the life of the circulating pump 11 but also improves its operational reliability.

Preferably, a muffler 17 is provided to envelop the outer periphery of the water inlet pipe 13 and the water outlet pipe 14 to reduce water flow and vibration noise, hereby create a quiet showering environment.

Preferably, housing 1 is provided with a loudspeaker 18, which includes a wireless transmission module; the transmission module supports a connection with an external terminal device such as a mobile phone or a tablet so that users can play music when they take a shower. The loudspeaker 18 is waterproof to be used in a humid environment.

The circulating heating water heater further comprises an air switch 19 and a soft bathtub 2; the air switch 19 is connected to the soft bathtub 2 via an air pipeline, which is provided with an air valve 191. An air pump is provided inside the air switch 19; the air pump is used to draw in and compress air; the air switch 19 is used to control air transportation to the soft bathtub 2 via the air pipe 192. Thanks to such design, it generates a suitable impulse during shower, thereby realizes a hydraulic massage function.

Preferably, a two-way valve 1411 is respectively arranged on the water inlet pipe 13 and the water outlet pipe 14; the two-way valve 1411 adopts a ball valve with a small flow resistance but a strong flow capacity; the two-way valve 1411 is used to control the water path in open or off state; when the two-way valve 1411 is open, water in the soft bathtub 2 will flow back to the circulating heating system, correspondingly, water in the circulating heating system will flow to the soft bathtub 2.

The soft bathtub 2 comprises a cavity 211; the inner surface of cavity 211 is provided with a plurality of nozzles 212, at least two backwater outlets 213 and a filter 214.

Figure 4:
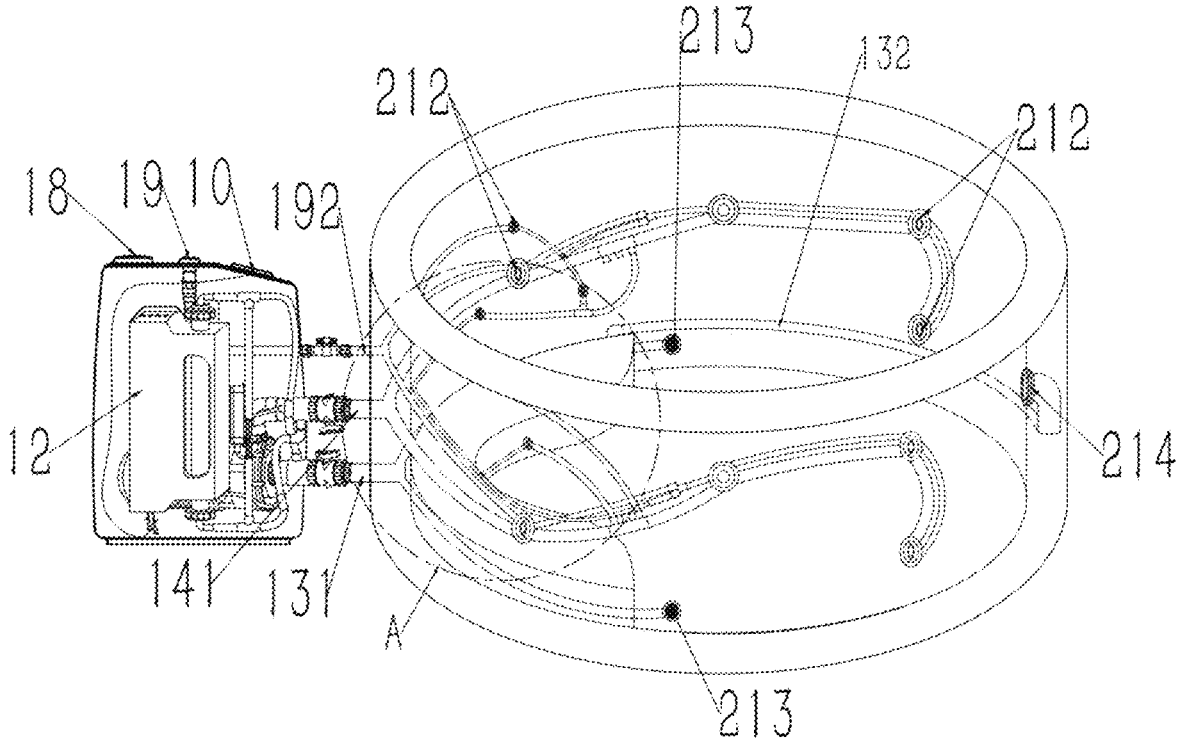
FIG. 4 is another schematic diagram of the circulating heating water heater.
Figure 5:
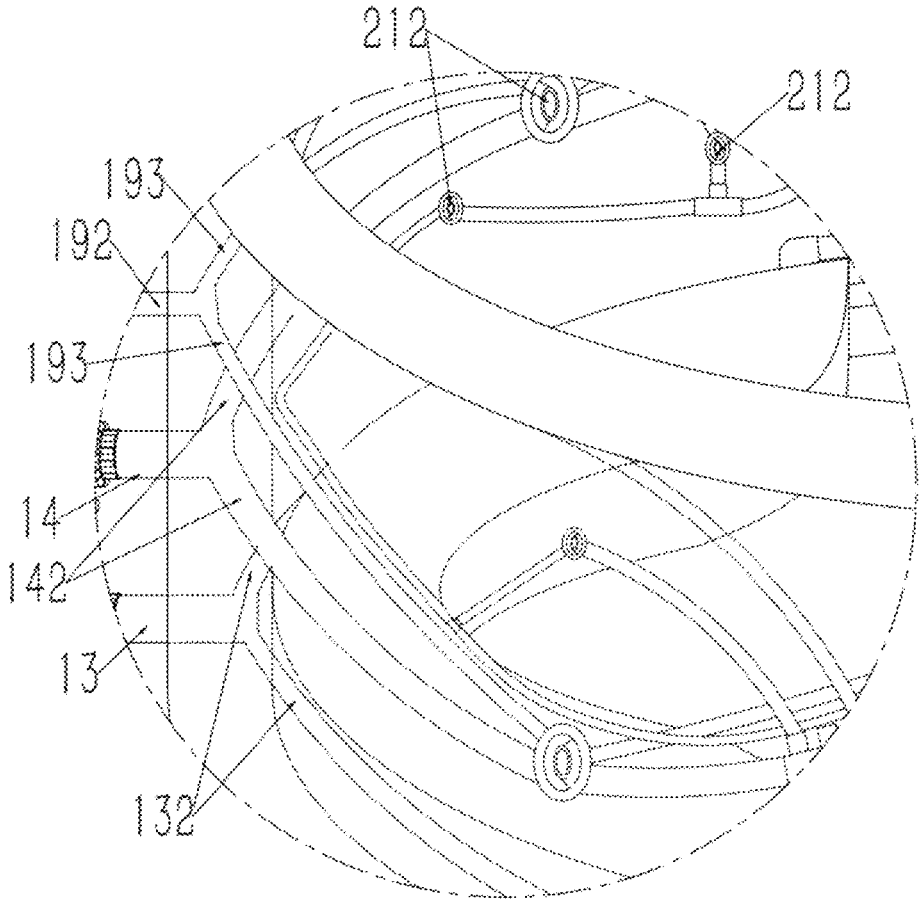
FIG. 5 is an enlarged view of portion A in FIG. 4.

Referring to FIG. 4 and FIG. 5, a pipe layout is provided between the soft bathtub 2 and the circulating heating system. Specifically, the water outlet pipe 14 communicates with the plurality of nozzles 212 via transportation pipe 142; the air pipe 192 communicates with the plurality of nozzles 212 via an air duct 193; the backwater outlet 213 communicates with the water inlet pipe 13 via a backwater pipe 132, and the filter 214 communicates with the water inlet pipe 13 via a backwater pipe 132.

It can be understood that, both the backwater outlet 213 and the filter 214 are able to absorb water into backwater pipe 132; the backwater outlet 213 and the filter 214 communicates with the water backwater pipe 132; the water in the cavity 211 will flow into the backwater pipe 132 and the water inlet pipe 13 to reach the circulating heating system; water in the circulating heating system will enter the transportation pipe 142 from the water outlet pipe 14, and then sprays into the cavity 211 through the plurality of nozzles 212.

The plurality of nozzles 212 comprises two specifications nozzles, one is of about 40 mm diameter, and another is of about 90 mm diameter; the air switch 19 communicates with an air duct 193 via an air pipe 192; when the air valve 191 is open, the air produced by the air pump will blow to the air duct 193 via the air pipe 192. Finally, the air is ejected from the plurality of nozzle 212; and the air in the air pipe 192 is released from tiny holes around the plurality of nozzles 212; hereby a large number of bubbles are generated in water; when the bubbles burst, it creates a soft massage feeling for users following with a white noise "hiss", which provides users a gentle, dispersive air bubble massage.

In addition, the plurality of nozzles 212 are also in communication with a two-way valve 1411; when the two-way valve 1411 opens, water in the circulating heating system and the soft bathtub 2 will flow circularly. A filter 214 on the soft bathtub 2 serves to filter impurities of the water in the bathtub.

The circulating heating water heater further comprises a control panel 10; the control panel is electrically connected to the heater 12, the sterilizer 15 and the circulating pump 11. Users can have the circulating heating water heater work in a low-speed mode or a high-speed mode by the control panel 10.

It should be specially noted that the control principle between the control panel 10 and the sterilizer 15 is not protected by the present invention, either that between the heater 12 and the circulating pump 11. The present invention claims a liquid circulating structure and layout design; a person skilled in the art should know the circuit control principle of the control panel 10, which is not redundantly described herein.

In the low-speed mode, the water in the soft bathtub 2 enters the circulating heating system from the water inlet pipe 13, passes through the water inlet tee valve 131 and then flows to the first cooling tee valve 161 and the circulating pump 11; the first cooling tee valve 161 diverts the water to the diverter tee valve 151 and the cooling hose 16; the water in the cooling hose 16 flows to the second cooling tee valve 162, while the water flowing in the diverter tee valve 151 will be diverted to the heater 12 and the sterilizer 15. The water in the heater 12 and the sterilizer 15 then flows out to the second cooling tee valve 162 through the jointer tee valve 152, and the water flows out from the cooling hose 16 join together in the second cooling tee valve 162; then flows into the water outlet tee valve 141. Meanwhile, the water in the circulating pump 11 flows to the water outlet tee valve 141 and finally flows out from water outlet pipe 14. Here, one circulating heating process completes, and the next circulating heating process continues.

In the high-speed mode, the heater 12 and the sterilizer 15 do not work, but the flow direction and circulating process of the water are the same as that in the low-speed mode, which will not be redundantly described herein.

It could be understood that under the guidance of the above embodiments, those skilled in the art can combine various implementation methods in the above embodiments to obtain technical solutions of multiple implementation methods.

The above description is only a preferred embodiment of the present invention and is not to limit the present invention. Any modifications, equivalent substitutions and improvements made within the spirit and principles of the present invention should be included in the scope of protection of the present invention.

The invention claimed is:

1. A circulating heating water heater, comprising a circulating heating system, wherein the circulating heating system comprises a housing, a circulating pump, a heater, a water inlet pipe and a water outlet pipe; the circulating pump and the heater are arranged inside the housing; a water inlet of the circulating pump communicates the water inlet pipe with a water inlet of the heater via a water inlet tee valve; a water outlet of the circulating pump communicates the water outlet pipe with a water outlet of the heater via another water outlet tee valve; the water outlet pipe and the water inlet pipe extend to an outside of the housing; the circulating heating water heater further comprises a soft bathtub, which includes a cavity; an inner surface of the cavity is provided with a plurality of nozzles, at least two backwater outlets and a filter.

2. The circulating heating water heater according to claim 1, wherein the water inlet pipe and the water outlet pipe are provided with a two-way valve respectively.

3. The circulating heating water heater according to claim 1, wherein a cooling hose is wound around an outer periphery of the circulating pump; one end of the cooling hose communicates with a vertical entrance of a first cooling tee valve; two horizontal entrances of the first cooling tee valve respectively communicate with the water inlet of the heater and the water inlet tee valve; another end of the cooling hose communicates with a vertical entrance of a second cooling tee valve; two horizontal entrances of the second cooling tee valve respectively communicate with the water outlet of the heater and the water outlet tee valve.

4. The circulating heating water heater according to claim 1, wherein a muffler is provided to envelop the water inlet pipe and the water outlet pipe.

5. The circulating heating water heater according to claim 1, wherein the housing is provided with a loudspeaker; the loudspeaker comprises a wireless transmission module.

6. The circulating heating water heater according to claim 1, further comprising an air switch; the air switch communicates with the soft bathtub via an air pipe; the air pipe is provided with an air valve.

7. The circulating heating water heater according to claim 1, further comprising a diverter tee valve, a jointer tee valve and a sterilizer; two horizontal entrances of the diverter tee valve respectively communicate with the water inlet of the circulating pump and the water inlet of the heater; a vertical entrance of the diverter tee valve communicates a water inlet of the sterilizer; two horizontal entrances of the jointer tee valve respectively communicate with a water outlet of the heater and a water outlet of the circulating pump; a vertical entrance of the jointer tee valve communicates with a water outlet of the sterilizer.

8. The circulating heating water heater according to claim 7, wherein the sterilizer is an ozone sterilizer.

9. The circulating heating water heater according to claim 7, further comprising a control panel; the control panel is electrically connected to the heater, the sterilizer and the circulating pump.

* * * * *